US011992163B1

(12) United States Patent
Newman et al.

(10) Patent No.: US 11,992,163 B1
(45) Date of Patent: May 28, 2024

(54) TOILET SEAT ELEVATOR ASSEMBLY

(71) Applicants: Corey Newman, Cleveland, OH (US); Greg Jones, Cleveland, OH (US)

(72) Inventors: Corey Newman, Cleveland, OH (US); Greg Jones, Cleveland, OH (US)

( * ) Notice: Subject to any disclaimer, the term of this patent is extended or adjusted under 35 U.S.C. 154(b) by 0 days.

(21) Appl. No.: 17/968,358

(22) Filed: Oct. 18, 2022

(51) Int. Cl.
*A47K 13/10* (2006.01)
*A47K 13/00* (2006.01)
*A47K 13/28* (2006.01)

(52) U.S. Cl.
CPC ..... *A47K 13/10* (2013.01); *A47K 13/005* (2013.01); *A47K 13/28* (2013.01)

(58) Field of Classification Search
CPC ..... A47K 13/10; A47K 13/005; A47K 13/28
See application file for complete search history.

(56) References Cited

U.S. PATENT DOCUMENTS

| | | | | |
|---|---|---|---|---|
| 5,027,445 | A | 7/1991 | Locarno | |
| 8,763,169 | B2 | 7/2014 | Daniels et al. | |
| 2009/0013453 | A1* | 1/2009 | Landsberger | A47K 13/005 4/236 |
| 2017/0354302 | A1* | 12/2017 | Hobbs | A47K 13/005 |

* cited by examiner

*Primary Examiner* — Christine J Skubinna
(74) *Attorney, Agent, or Firm* — Sanchelima & Associates, P.A.; Christian Sanchelima; Jesus Sanchelima

(57) ABSTRACT

A toilet seat elevator assembly including a seat assembly. The seat assembly includes a seat that is placed on top of a toilet seat. The seat assembly is capable of being adjusted in height by adding a preferred amount of seat inserts between the toilet seat and the seat. The seat inserts have a toilet seat shape. The toilet seat elevator assembly further includes backup assembly, wherein is perpendicularly attached to an edge of the seat. The backup assembly is hollow, wherein the backup assembly can be clamped to the seat cover when it is in a vertical position allowing to secure the toilet seat elevator assembly to the toilet.

11 Claims, 2 Drawing Sheets

TOILET SEAT ELEVATOR ASSEMBLY

BACKGROUND OF THE INVENTION

1. Field of the Invention.

The present invention relates to a toilet seat and, more particularly, to a toilet seat elevator assembly that is capable of being adjusted in height by attaching a preferred amount of seat inserts.

2. Description of the Related Art.

Several designs for toilet seats have been designed in the past. None of them, however, include a toilet seat with an attached hinged lid wherein multiple seat inserts can be coupled to adjust the height of the seat assembly.

Applicant believes that a related reference corresponds to U.S. Pat. No. 5,027,445 issued for raised superimposed toilet sat and securing clamp. Applicant believes that another related reference corresponds to U.S. Pat. No. 8,763,169 issued for elevated toilet seat assembly. None of these references, however, teach of a toilet seat with an attached hinged cover and a securing clamp mechanism, wherein the assembly includes multiple toilet seat-shaped panels for adjusting the height of the seat assembly.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a comfortable seat position while using the toilet.

It is another object of this invention to promote a healthy back posture.

It is still another object of the present invention to provide a clamp mechanism to secure the present invention to the toilet seat.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
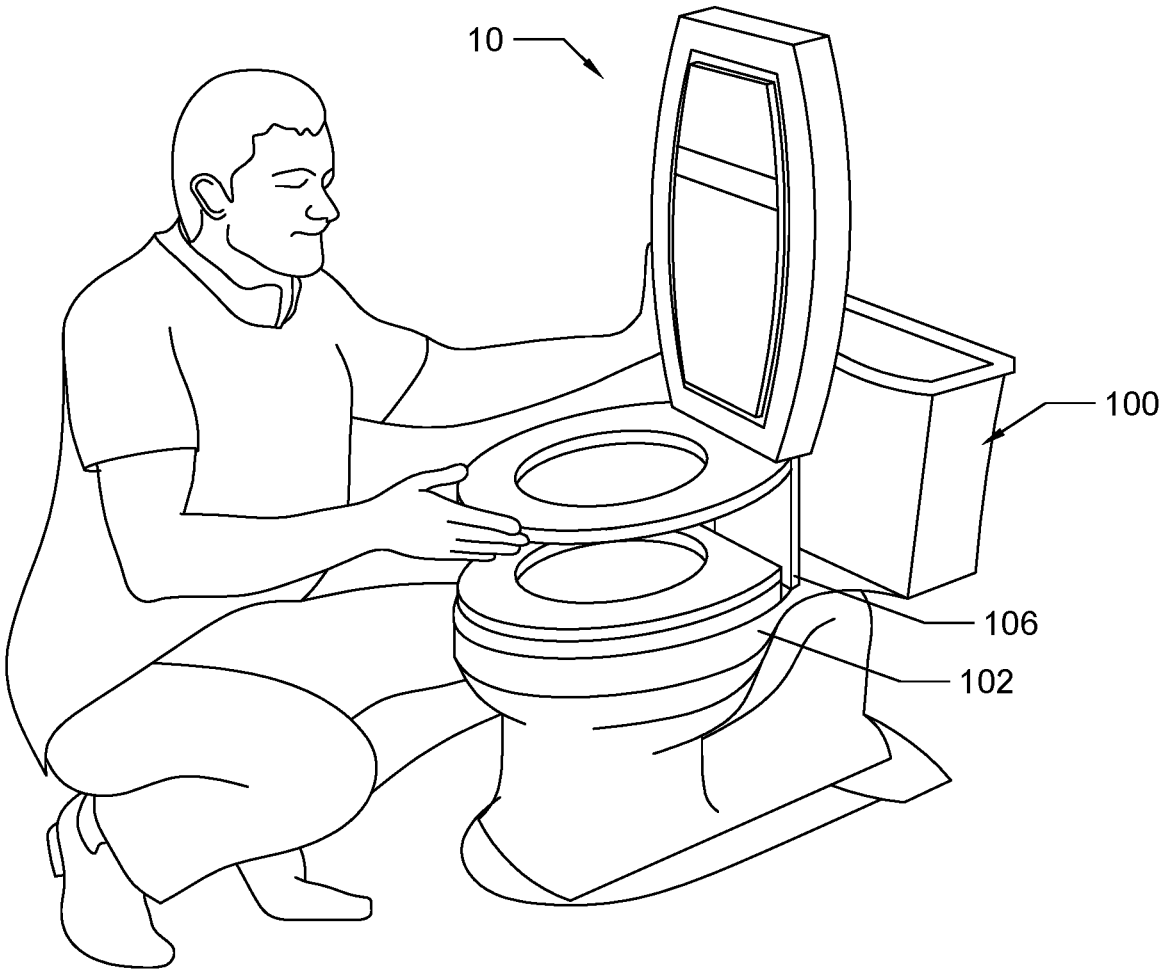
FIG. 1 represents an operational view of an exemplary embodiment of the present invention 10.

Referring now to the drawings, where the present invention is generally referred to with numeral 10, it can be observed that it basically includes a seat assembly 20, a backup assembly 40, a clamping assembly and various exemplary embodiments (100). It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Best illustrated in FIG. 1 in one embodiment of the present invention, seat assembly 20 may include a seat 22 with a toilet seat-shaped suitable to be placed on top of a toilet seat 104, wherein the toilet seat 104 is placed on a top surface of an upper rim of a toilet 100. Nevertheless, it should be considered that the seat 22 may have an oval form, an U shape, a round shape or any other suitable shape for toilet seats known in the art. The seat 22 may have a straight shape edge transition, wherein the straight shape edge is parallel to a front wall of a toilet water tank. In an exemplary embodiment, the seat 22 may be made of a laminated wood material, a plastic material, a polyresin material, a porcelain material or any other suitable material. In a suitable embodiment, a bottom portion of the seat 22 may be placed on a top surface of the toilet seat 104. An external periphery of the seat 22 may be placed parallel to an external periphery of the toilet seat 104. In a suitable embodiment, the seat 22 has an aperture in a center portion of the seat 22, wherein a periphery of the aperture is parallel to an aperture of the toilet seat 104. In other embodiments, seat assembly further includes a plurality of seat inserts 24. The plurality of seat inserts 24 may have a seat 22 shape, a toilet seat 104 shape or any other suitable variation for toilet seats known in the art. In one embodiment, the plurality of seat inserts 24 may be made of a laminated wood material, a plastic material, a polyresin material, a porcelain material or any other suitable material. The seat 22 is capable of being elevated allowing to place the plurality of seat inserts 24 between the seat 22 and the toilet seat 104. In a suitable embodiment, a periphery of the plurality of seat inserts 24 may be parallel to the periphery of the toilet seat 104.

Figure 2:
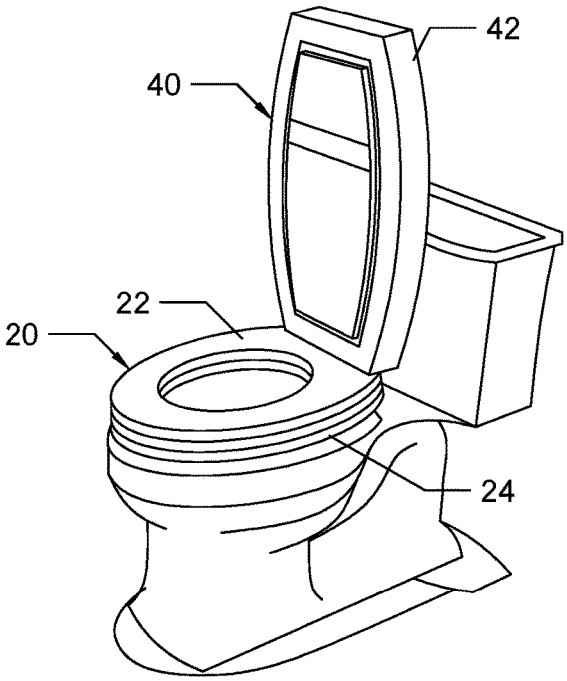
FIG. 2 shows an isometric view of the present invention 10, wherein a plurality of seat inserts 24 are attached below the seat 22.

Backup assembly 40 includes a back support 42, wherein the back support 42 may have an oval shape, wherein a portion of the periphery of the oval shape has a first straight shape edge transition, wherein the oval shape of the back support assembly 42 has a second straight shape edge transition placed oppositely to the first straight shape edge transition. In one embodiment, back support 42 may be made of a laminated wood material, a plastic material, a polyresin material, a porcelain material or any other suitable material. A portion of the periphery of the straight edge of the back support 42 may be attached to a portion of the straight edge of the seat 22, wherein the back support 42 may be parallel to the seat 22. Best depicted in FIG. 1. In a suitable embodiment, the back support 42 may have a suitable height to cover a portion of a user's back. In a suitable embodiment, back support 42 is capable of being elevated including the seat 22 permitting a preferred amount of the plurality of seat inserts 24 being inserted between the seat 22 and the toilet seat 104, thereby a user is capable of reaching a predetermined height of the seat 22. Best illustrated in FIG. 2. In an exemplary embodiment, backup support 42 has a hollow body 44 with an internal volume, wherein the back support 42 has an aperture to access to the internal volume.

Clamping assembly 60 includes a securing clamp mechanism 62. In one embodiment, the internal volume of the back support 42 may conforms a suitable volume wherein a portion of the seat cover 106 is capable of fit, thereby a feature of the coupling between the seat cover 106 and the internal volume of the back support 42 may function as a securing clamp mechanism 62 allowing to secure the back support 42 to the seat cover 106 preventing an unintended movement of the seat 22.

Figure 3A:
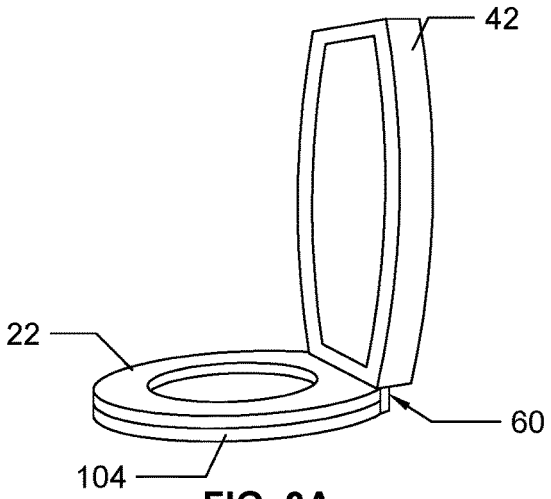
FIG. 3A illustrates an isometric view of the seat 22 and the backup assembly 40 are placed on top of a toilet seat indicating that the back support 42 can be pulled to elevate.
Figure 3B:
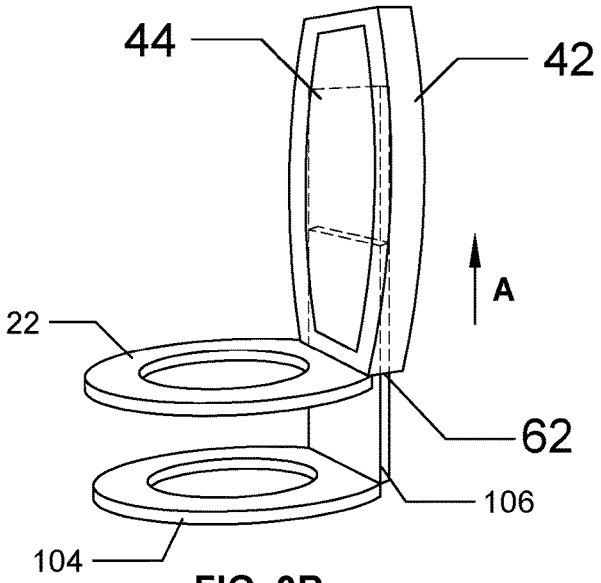
FIG. 3B is a representation of an isometric view of the seat cover 106 while inserted within the hollow body 44 of the back support 42, creating the securing clamp mechanism 62.

The seat 22 attached to the back support 42 may be placed at the top surface of the toilet seat 104, wherein is secured by means of the securing clamp mechanism 62, thereby the back support 42 has vertical degree of freedom allowing it to be elevated including the seat 22 attached thereof. FIG. 3A illustrates the present invention 10 coupled on top of the toilet seat 104 and FIG. 3B shows an elevated configuration of the present invention 10, wherein a user is capable of elevate the back support 42 including the seat 22 from the toilet seat 104 in a preferred height allowing to insert the plurality of seat inserts 24 therebetween.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A toilet seat elevator assembly, comprising:

a seat assembly including a seat and a plurality of seat inserts, said seat is placed on top of a toilet seat, wherein said seat can be elevated by means of a plurality of seat inserts;

a backup assembly having a back support, wherein said back support is perpendicularly attached to said seat; and a clamping assembly, including a securing clamp mechanism, wherein said securing clamp mechanism is placed within said back support allowing to secure said backup support to a toilet.

2. The toilet seat elevator assembly of claim 1, wherein said seat has a toilet seat shape, said plurality of seat inserts have a toilet set shape.

3. The toilet seat elevator assembly of claim 1, wherein said plurality of seat inserts are placed between said seat and said toilet seat.

4. The toilet seat elevator assembly of claim 1, wherein said seat has straight shape edge transition in a portion of a periphery thereof.

5. The toilet seat elevator assembly of claim 1, wherein said back support has an oval shape.

6. The toilet seat elevator assembly of claim 5, wherein said backup support has two straight shape edge transitions in a portion thereof oppositely placed one from each other.

7. The toilet seat elevator assembly of claim 1, wherein said back support is attached to said seat by means of the straight shape edge transition thereof.

8. The toilet seat elevator assembly of claim 1, wherein back support has a hollow body, said hollow body is configured to receive a seat cover.

9. The toilet seat elevator assembly of claim 1, wherein said securing clamp mechanism allows said back support a vertical degree of freedom.

10. A toilet seat elevator assembly, comprising:

a seat assembly including a seat and a plurality of seat inserts, wherein said seat and said plurality of seat inserts have a toilet seat shape, said seat is placed on top of a toilet seat, wherein a periphery of said seat is parallel to a periphery of said toilet seat, wherein said seat can be elevated by means of a plurality of seat inserts;

a backup assembly having a back support, wherein said back support has a straight shape edge transition on a portion periphery thereof, said back support is perpendicularly attached to a portion of a periphery of said seat; and a clamping assembly, including a securing clamp mechanism, wherein said securing clamp mechanism is placed within said back support allowing to secure said backup support to a toilet, said clamp mechanism permits a vertical degree of movement of said back support.

11. A toilet seat elevator assembly, consisting of:

a seat assembly including a seat and a plurality of seat inserts, wherein said seat and said plurality of seat inserts have a toilet seat shape, said seat is placed on top of a toilet seat, wherein a periphery of said seat is parallel to a periphery of said toilet seat, wherein a plurality of seat inserts is placed between said seat and said toilet seat allowing said seat to be in a higher position;

a backup assembly having a back support, wherein said back support has two straight shape edge transition on a portion periphery thereof oppositely placed one from each other, said back support is perpendicularly attached to a portion of a periphery of said seat, said back support has a hollow body, wherein said hollow body allows said back support to have an internal volume, wherein said back support has an aperture to access to said internal volume; and a clamping assembly, including a securing clamp mechanism, wherein said securing clamp mechanism is placed within said back support allowing to secure said backup support to a seat cover, wherein in said seat cover fits inside of said internal volume of said back support, said clamp mechanism permits a vertical degree of movement of said back support.

* * * * *